US007852304B2

(12) United States Patent
Lee et al.

(10) Patent No.: US 7,852,304 B2
(45) Date of Patent: Dec. 14, 2010

(54) DRIVING CIRCUIT, SYSTEM, AND METHOD TO IMPROVE UNIFORMITY OF COLUMN LINE OUTPUTS IN DISPLAY SYSTEMS

(75) Inventors: Cheung Fai Lee, Hong Kong (HK); Yiu Sang Lei, Kowloon (HK); Ki Leung Mak, Hong Kong (HK)

(73) Assignee: Solomon Systech Limited, Shatin, N.T. (HK)

( * ) Notice: Subject to any disclaimer, the term of this patent is extended or adjusted under 35 U.S.C. 154(b) by 1181 days.

(21) Appl. No.: 11/489,464

(22) Filed: Jul. 20, 2006

(65) Prior Publication Data

US 2008/0018585 A1 Jan. 24, 2008

(51) Int. Cl.
*G09G 3/36* (2006.01)

(52) U.S. Cl. ..... 345/98; 345/87

(58) Field of Classification Search ..... 345/87–111
See application file for complete search history.

(56) References Cited

FOREIGN PATENT DOCUMENTS

KR 2003-056005 12/2001

OTHER PUBLICATIONS

English language Derwent Abstract of KR 2003-056005, Dec. 27, 2001.

Peter R. Kinget, "Device Mismatch and Tradeoffs in the Design of Analog Circuits", IEEE, Journal of Solid-State Circuits, vol. 40, No. 6, Jun. 2005, pp. 1212-1224.

T. Shima et al., "Principle and Applications of an Autocharge-Compensated Sample and Hold Circuit", IEEE, Journal of Solid-State Circuits, vol. 30, No. 8, Aug. 1995, pp. 906-912.

Marshall J. Bell, "An LCD Column Driver Using a Switch Capacitor DAC", IEEE, Journal of Solid-State Circuits, vol. 40, No. 12, Dec. 2005, pp. 2756-2765.

*Primary Examiner*—Srilakshmi K Kumar
(74) *Attorney, Agent, or Firm*—Finnegan, Henderson, Farabow, Garrett & Dunner, LLP

(57) ABSTRACT

A driver circuit, display system, and method includes a driver circuit that provides driving signals to drive a plurality of display pixel elements arranged in a plurality of rows and columns and coupled to associated row and column lines, respectively. The driver circuit includes a plurality of driver units coupled to associated ones of the plurality of column lines, and a plurality of switching components respectively coupled between outputs of ones of the driver units coupled to adjacent ones of the plurality of column lines. The driver units control associated ones of the switching components to electrically couple the adjacent outputs of the driver units to make the outputs the same or substantially the same when display data signals received for pixel elements coupled to the adjacent column lines are the same.

16 Claims, 11 Drawing Sheets

DRIVING CIRCUIT, SYSTEM, AND METHOD TO IMPROVE UNIFORMITY OF COLUMN LINE OUTPUTS IN DISPLAY SYSTEMS

BACKGROUND

Flat panel displays, such as liquid crystal displays ("LCDs") and organic light emitting displays ("OLEDs"), typically have a matrix of display pixel elements arranged in rows and columns that is driven by a display driver circuit. The display driver circuit includes driver units that provide column line outputs to drive display pixel elements in respective columns of the display matrix. The display image quality depends on uniformity of the column line outputs provided by the driver units of the display driver circuit. When there are driver non-uniformities among the column line outputs, the output signals supplied to the column lines may not accurately drive the display pixel elements according to input display data signals. More specifically, when there are non-uniformities among the column line outputs, the pixel brightness of each pixel element may not conform to the desired brightness. For color images, such non-conformance can lead to color non-uniformities. Thus, the display image quality depends on the drive uniformity of the column line outputs.

Such non-uniformities in pixel brightness and color may be found in all flat-panel display systems, including both passive matrix and active matrix types of display systems. Manufacturing variations result in parameter variations in the integrated circuitry of the display driver circuit, leading to performance mismatches between otherwise identically designed circuits. In response, circuit designers can make use of device dimensions, such as area, width, and length; device layout; circuit configuration; and device bias point to control mismatching. Nevertheless, in display driver circuits, both systematic and random variations may occur in large numbers of identically designed drive units for respective columns of the display matrix and affect the quality of the displayed image. Thus, because there are typically hundreds of driver units in a display driver circuit, there is greater potential for drive non-uniformity due to manufacturing variations in the integrated circuit.

Using an active matrix thin film transistor ("TFT") liquid crystal display as an example, FIG. 1 shows a gamma curve that indicates a relationship of output brightness level of the display to a driver unit output voltage level to the column lines. The gamma curve generally corresponds at least to all pixel elements of the same color, and can correspond to all pixel elements. The output voltage of each driver unit can take on different voltage levels, e.g., VGL0 to VGL63, respectively corresponding to grey levels of display brightness, e.g., GL0 to GL63 in the case of six-bit display data. For any row of display pixel elements, when the display data are the same across several columns, the outputs of the driver units for those columns should be the same voltage level in order to drive the adjacent display pixels elements at the same brightness. In practice, however, because of manufacturing variations, the output levels among the identically designed driver units may exhibit small variations. As seen in Case 1 in FIG. 1, two identical driver units produce Output 1 and Output 2 for adjacent pixel elements pixel 1 and pixel 2, that vary from each other and from the desired grey level of VGL(N). Ideally, for uniform drive, the two identical driver units should produce the same output, i.e., Output 1=Output 2, as seen in Case 2 in FIG. 1.

Visual perception is more sensitive to the effect of small output variations in close proximity than to the effect of small offsets from an ideal absolute output level. Thus, output variations of adjacent driver units are more visually noticeable. Several approaches have been taken to reduce output non-uniformity. First, in designing driver units, the direct approach to achieve output uniformity is to reduce the design's sensitivity to process variations. This approach uses large device dimensions, such as area, width, length, and spacing to minimize the effects of manufacturing variations. An example of this approach can be found in Kinget, Peter R., "Device Mismatch and Tradeoffs in the Design of Analog Circuits," *IEEE J. Solid-State Circuits*, vol. 40, no. 6, pp. 1212-24, June 2005.

Another approach to increase output drive uniformity uses physical layout techniques of symmetry and common-centroid to average the effects of manufacturing variations. Such methods can reduce the offsets and variations in the outputs of driver units. Buffer amplifier offset can also be a significant cause of driver unit output non-uniformity. Examples of ways to reduce buffer amplifier offset are, for example, by auto-charge-compensated sampling, such as described in Shima, T. et al., "Principle and Applications of an Autocharge-compensated Sample and Hold Circuit," *IEEE J. Solid-State Circuits*, vol. 30, no. 8, pp. 906-12, August 2005, or by switch capacitor offset compensation techniques, such as described in Bell, Marshall, "An LCD Column Driver Using a Switch Capacitor DAC," *IEEE J. Solid-State Circuits*, vol. 40, no. 12, pp. 2756-65, December 2005.

Yet another technique for increasing drive uniformity is a "multi-driving" approach described in Korean patent number KR2003056005 and shown in FIG. 2. This multi-driving circuit includes a resistive voltage divider 20, a first amplifier 21, and a second amplifier group, comprised of amplifiers 22*a*, 22*b*, and 22*c*. Voltage divider 20 divides a predetermined gamma reference voltage and outputs the divided voltages V(m) to first amplifiers, such as first amplifier 21. First amplifier 21 amplifies the divided voltage and sends the divided voltage to a set of decoders 26. Amplifiers 22*a*, 22*b*, and 22*c*, in the second amplifier group, receive respective output signals from a set of decoders 26 and provide power to drive a load at the output to the predetermined gamma reference voltage. During operation, column line outputs, Y1, Y2, and Y3, are respectively driven by amplifiers 22*a*, 22*b*, and 22*c*. Amplifiers 22*a*, 22*b*, and 22*c* of the second amplifier group have high slew-rate properties, which provides a fast response for the column line outputs Y1, Y2, and Y3. Near the end of the line period, column line outputs Y1, Y2, and Y3 are coupled to decoder outputs by switches 25*a*, 25*b*, and 25*c*. Output non-uniformities due to driving variations of amplifiers 22*a*, 22*b*, and 22*c* are thus averaged, since the outputs of individual decoders 26*a*, 26*b*, and 26*c* of the set of decoders 26, are all driven from first amplifier 21.

This multi-driving approach requires first amplifier 21 to have large driving capability for driving column line outputs Y1, Y2, and Y3, and to maintain stability under a range of loading conditions that are dependent on display data. In the traditional voltage divider approach, first amplifiers 21 are deployed infrequently at relatively few divider points. This multi-driving approach may require first amplifiers 21 at more divider points to reduce the loading effects on resistive voltage divider 20. Timing control of switches 25*a*, 25*b*, and 25*c* is also required for the operation and can become more difficult with increasing display resolution and display size.

The techniques mentioned above can improve drive uniformity, but they require significant additional circuitries, silicon area, and/or power consumption to minimize drive non-uniformities. Even with the techniques described above, some small non-uniformities will invariably remain due to practical limits, such as the acceptable amount of increase to device dimensions or layout configurations. For example, autocharge-compensated sampling and switch capacitor offset compensation may be undesirable choices for driver unit design because, due to the large number of outputs requiring compensation, they may require unacceptably large amounts of additional silicon area and may consume large amounts of power. In addition, switch capacitor techniques may require special attention to issues of charge injection, nonlinear MOS capacitor characteristics, switch size effects, critical timing of control signals, and unavoidable non-uniformities due to process variations. Thus, some level of driver unit output non-uniformity will remain due to practical limits in resolving such issues.

SUMMARY

In accordance with exemplary embodiments consistent with the invention, there is provided a driver circuit for providing driving signals to drive a plurality of display pixel elements arranged in a plurality of rows and columns in a display system, the rows and columns of display pixel elements being coupled to associated ones of the row and column lines, respectively. The driver circuit comprises a plurality of driver units coupled to associated ones of the plurality of column lines, each of the driver units being configured to receive display data signals for the associated column line and an adjacent one of the column lines, and to provide a drive signal on a driver unit output to the display pixel elements coupled to the associated column line; and a plurality of switching components respectively coupled between the outputs of ones of the driver units coupled to adjacent ones of the plurality of column lines, and configured to electrically couple the adjacent outputs in response to a control signal from an associated one of the driver units when the display data signals for the adjacent column lines are the same.

In addition, in accordance with exemplary embodiments consistent with the invention, there is provided a method for controlling driving signals from a driver circuit to drive a plurality of display pixel elements arranged in a plurality of rows and columns in a display system, the rows and columns of display pixel elements being coupled to associated row and column lines, respectively. The method comprises receiving display data signals for associated column lines; providing drive signals to display pixel elements in associated column lines; and coupling together adjacent column lines when the display data signals associated with the adjacent columns lines are the same, to make the drive signals provided to the adjacent column lines the same.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention.

In the drawings.

DESCRIPTION OF THE EMBODIMENTS

Embodiments consistent with the present invention may be implemented in any appropriate display system including, but not limited to, a supertwist nematic liquid crystal display ("STN-LCD") system, a thin-film transistor liquid crystal display ("TFT-LCD") system, a passive matrix organic light emitting diode ("PMOLED") display system, an active matrix organic light emitting diode ("AMOLED") display system, a light-emitting diode ("LED") display system, a surface-conduction electron-emitter ("SED") display system, or any display that is sensitive to output-to-output variations.

Figure 1:
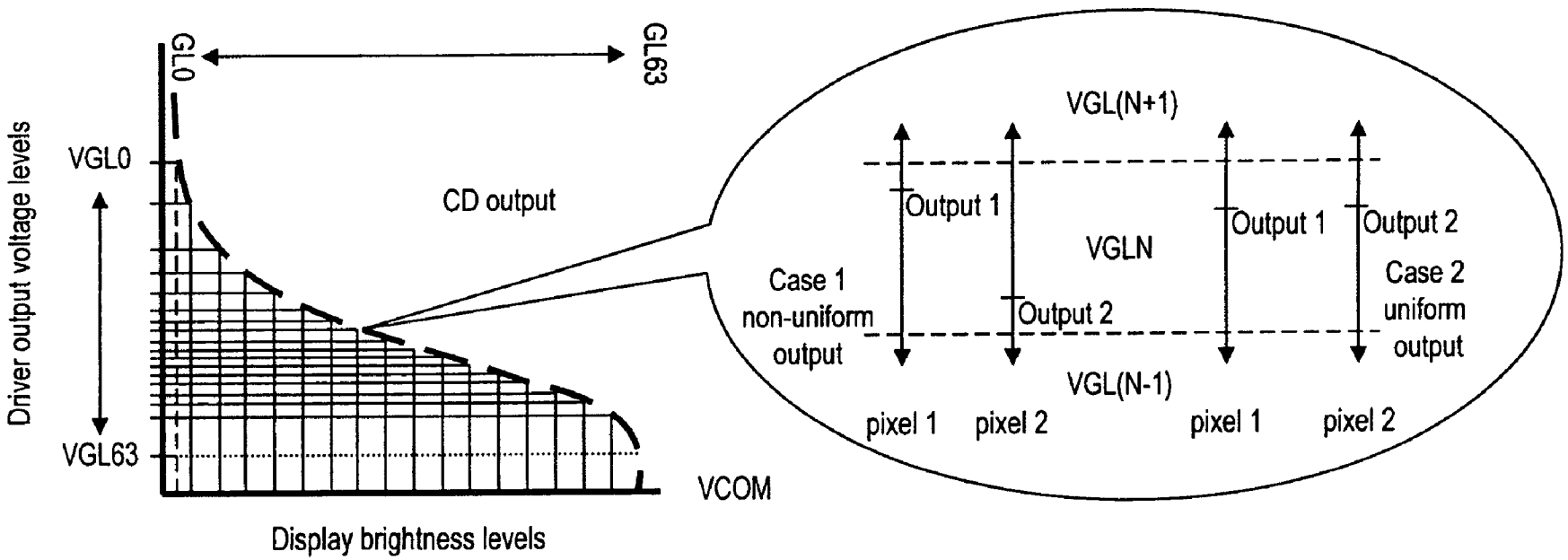
FIG. 1 is a representation of a gamma curve, indicating a relationship between an output brightness of a pixel element in a display and a voltage output from a driver unit to a column line.
Figure 2:
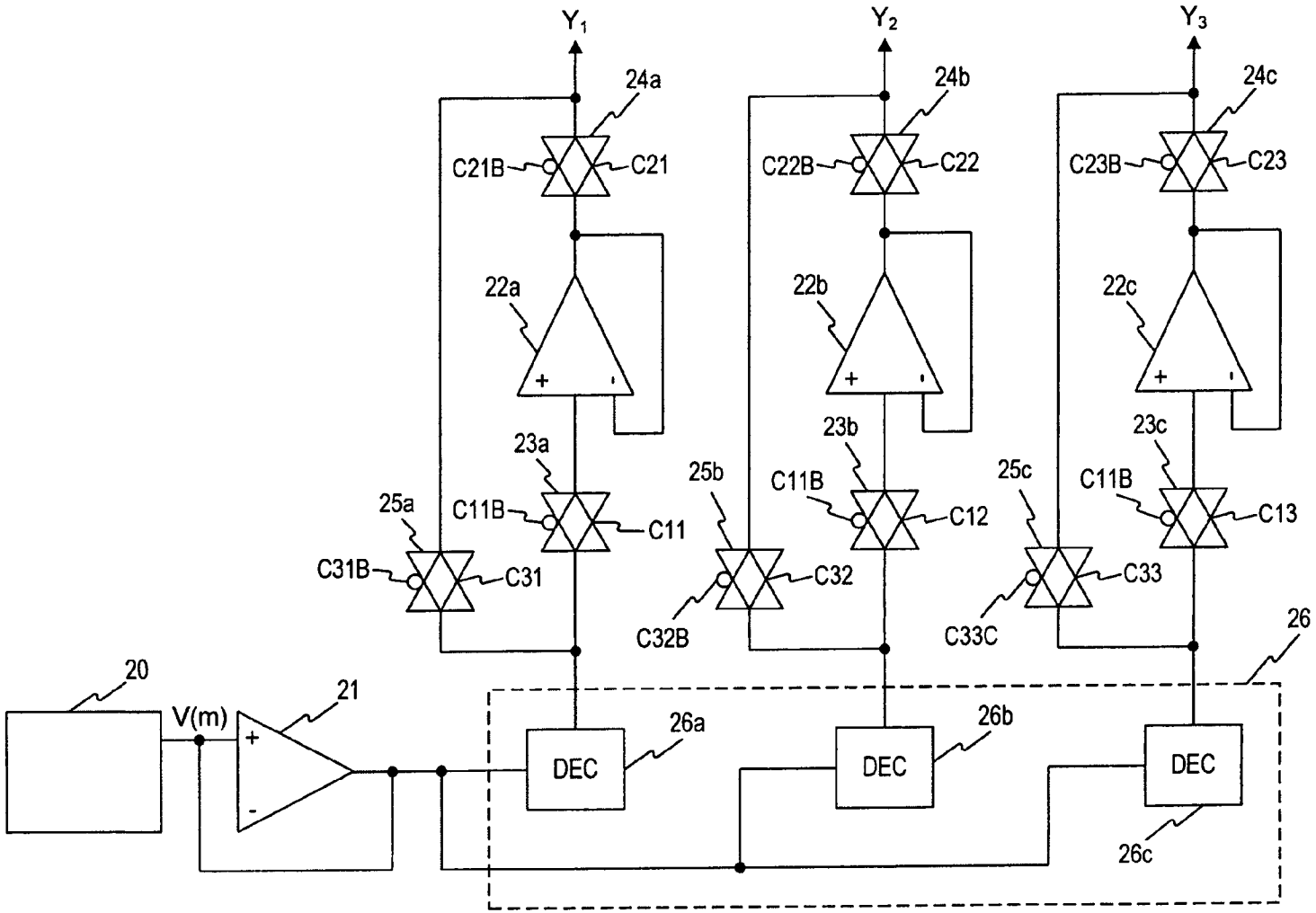
FIG. 2 is a block diagram representation of a driver circuit employing a "multi-driving" approach to increase drive uniformity.
Figure 3:
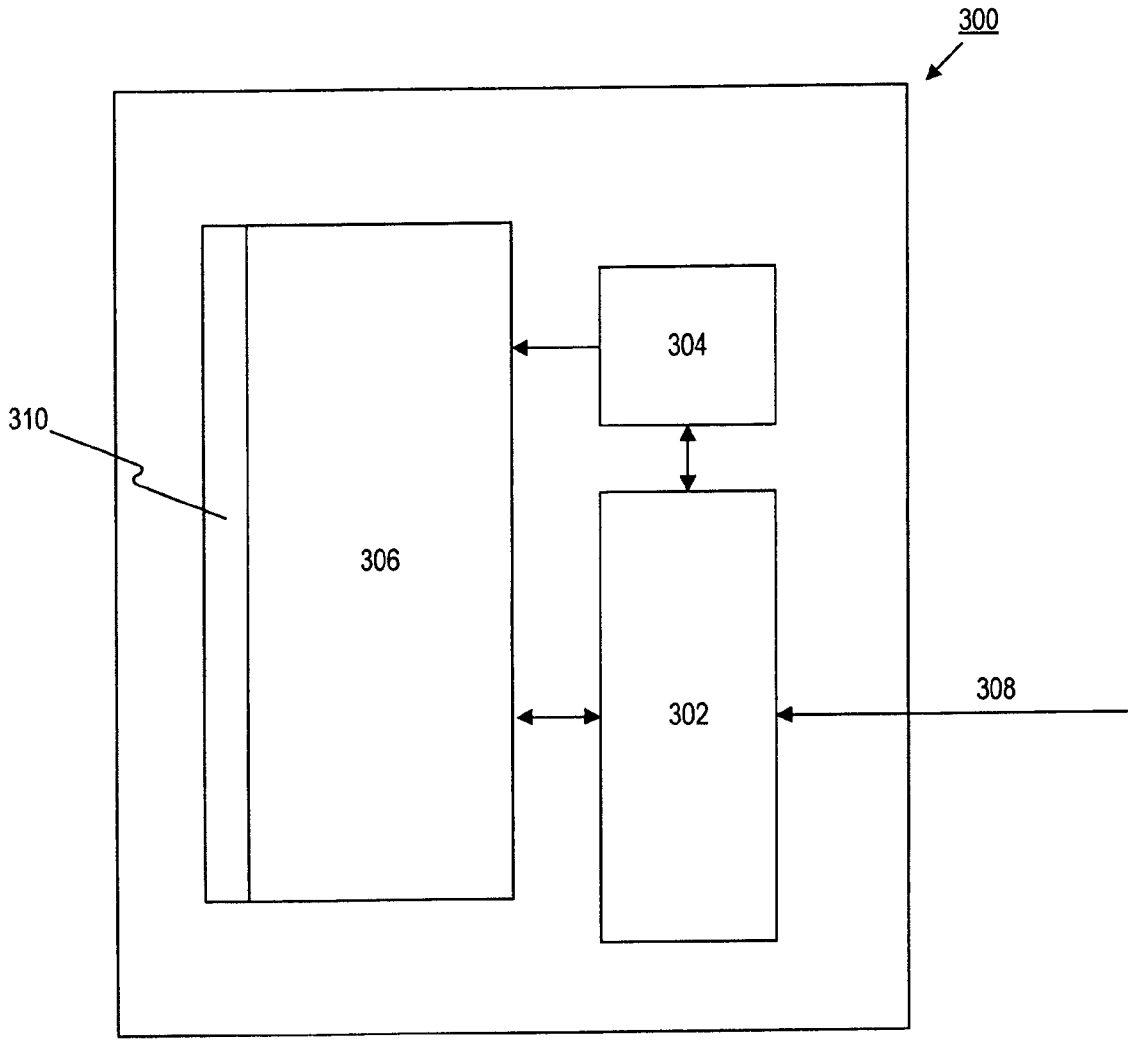
FIG. 3 is a block diagram representation of a display system consistent with an embodiment of the present invention.

FIG. 3 shows a display system 300 consistent with an embodiment of the present invention. Display system 300 includes a controller 302, a graphic memory unit 304, a driver circuit 306, and a matrix of display pixels elements 310. Display system 300 is configured to receive display data from a data line 308.

Controller 302 is coupled to graphic memory unit 304 and driver circuit 306. Controller 302 is configured to receive display data from data line 308 and supply display data to graphic memory unit 304, driver circuit 306, or both. Controller 302 may also perform any appropriate function or operation known in the art, such as supplying control signals to graphic memory unit 304 and driver circuit 306 to control driver signals sent to pixel elements in matrix of display pixel elements 310. Display data may take the form of any appropriate data known in the art. For example, display data may represent either gray level display data or color display data, and may be in digital form. Controller 302 also controls display data supplied to matrix of display pixel elements 310. Controller 302 controls the output of supplied display data, from either itself or graphic memory unit 304, by reading the display data row by row.

Graphic memory unit 304 is coupled to controller 302 and driver circuit 306. Graphic memory unit 304 stores display data that is to be transferred to driver circuit 306.

Driver circuit 306 is coupled to controller 302, graphic memory unit 304, and matrix of display pixel elements 310. Driver circuit 306 is configured to receive display data signals from controller 302, graphic memory unit 304, or both. Driver circuit 306 is also configured to supply drive signals to pixel elements in matrix of pixel elements 310, based on the received display data signals. Driver circuit 306 also receives control signals from controller 302 to control the driver signals supplied by driver circuit 306 to pixel elements in matrix of display pixel elements 310.

Matrix of display pixel elements 310 may be configured as rows and columns of pixel elements and coupled to driver circuit 306 to receive driver signals to drive the pixel elements in the matrix. Pixel elements may be configured to display any appropriate display known in the art, such as gray level, color, or both.

Figure 4:
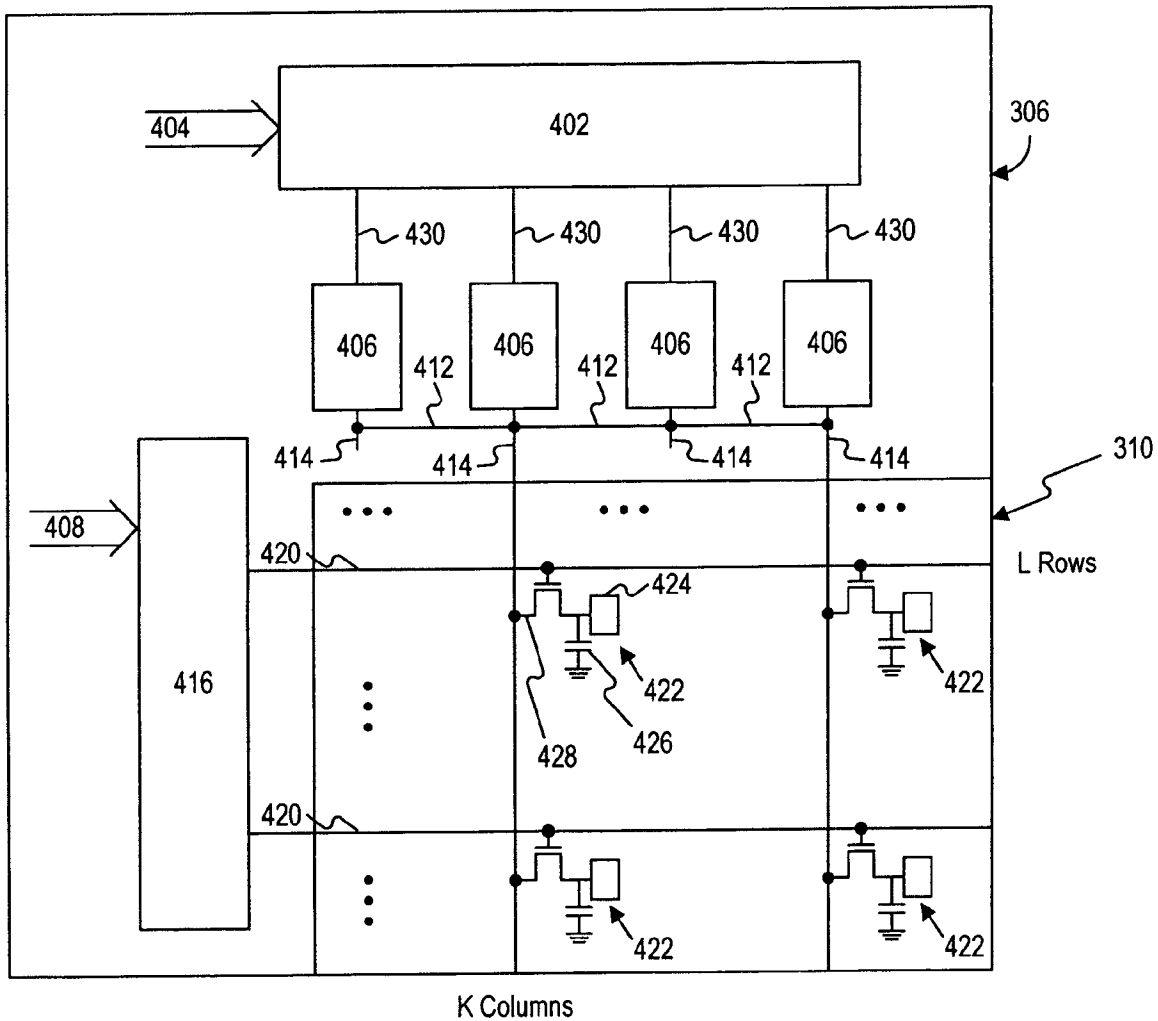
FIG. 4 is a block diagram representation of a driver circuit and matrix of display pixel elements included in the display system shown in FIG. 3 consistent with a first exemplary embodiment.

FIG. 4 shows driver circuit 306 and matrix of display pixel elements 310 consistent with a first exemplary embodiment. In the first exemplary embodiment, driver circuit 306 includes a column shift register 402, driver units 406, and a gate driver 416. Driver circuit 306 is coupled to matrix of display pixel elements 310 via a plurality of row and column lines 420 and 414, respectively. Driver circuit 306 is configured to receive control and display data signals from controller 302, graphic memory unit 304, or both.

Matrix of display pixel elements 310 may comprise L row lines and K column lines, where both L and K are integers greater than or equal to one. Matrix of display pixel elements 310 comprises a plurality of pixel units 422. Pixel units 422 include a pixel element 424, a filtering component 426, and a switching component 428. Switching component 428 may be any appropriate switching component known in the art. For example, switching component 428 may be a MOSFET having a gate coupled to one of the row lines 420 associated with pixel unit 422, a source or drain coupled to one of the column lines 414 associated with the pixel unit 422, and the other of its source or drain coupled to pixel element 424 and filtering component 426 associated with pixel unit 422. Filtering component 426 may be any appropriate filtering component known in the art, such as a capacitor coupled between the input of pixel element 424 and ground. Matrix of display pixel elements 310 is configured to receive drive signals from driver units 406 and gate driver 416, which drive pixel elements 424 in pixel units 422. Pixel elements 424 may be any appropriate pixel element known in the art, and output, for example, gray level or color.

Gate driver 416 is coupled to matrix of display pixels elements 310 via L row lines 420. Gate driver 416 is configured to receive input signals 408, which may be any appropriate signals, such as row clock signals and/or row synchronization signals. Gate driver 416 is configured to receive signals 408 from controller 302, graphic memory unit 304, or both. Gate driver 416 drives pixel elements 424 in matrix of display pixel elements 310 based on the received signals 408.

Column shift register 402 is coupled to driver units 406 via lines 430. Lines 430 may provide to any appropriate signals known in the art. For example, each of lines 430 may represent multiple lines, where one of the lines represents a display data signal sent to the respective driver unit 406 and another of the lines represents sets of reference gamma voltages sent to all driver units 406. Column shift register 402 is also configured to receive input signals 404. Input signals 404 may be any appropriate signals known in the art. For example, input signals 404 may include display data signals, column clock signals, and/or column synchronizing signals. Column shift register 402 is configured to receive input signals 404 from controller 302, graphic memory unit 304, or both. Based on the received input signals 404, column shift register 402 supplies display data signals to driver units 406 via lines 430.

Driver units 406 are coupled to matrix of display pixel elements 310 via column lines 414 and to column shift register 402 via lines 430. Outputs of adjacent driver units 406 are coupled together via lines 412. Lines 412 may include a switching component (not shown) that is controllable to selectively electrically couple adjacent driver units 406. Driver units 406 are configured to receive as input signals, any appropriate signal known in the art. For example, driver units 406 may receive display data signals from column shift register 402 via lines 430. Driver units 406 may also receive as input signals, an output control signal (not shown) from controller 302. Driver units 406 supply driving signals to matrix of display pixel elements 310 via column lines 414. The driving signals may be any appropriate driving signal known in the art, such as voltage driving signals or current driving signals.

Figure 5:
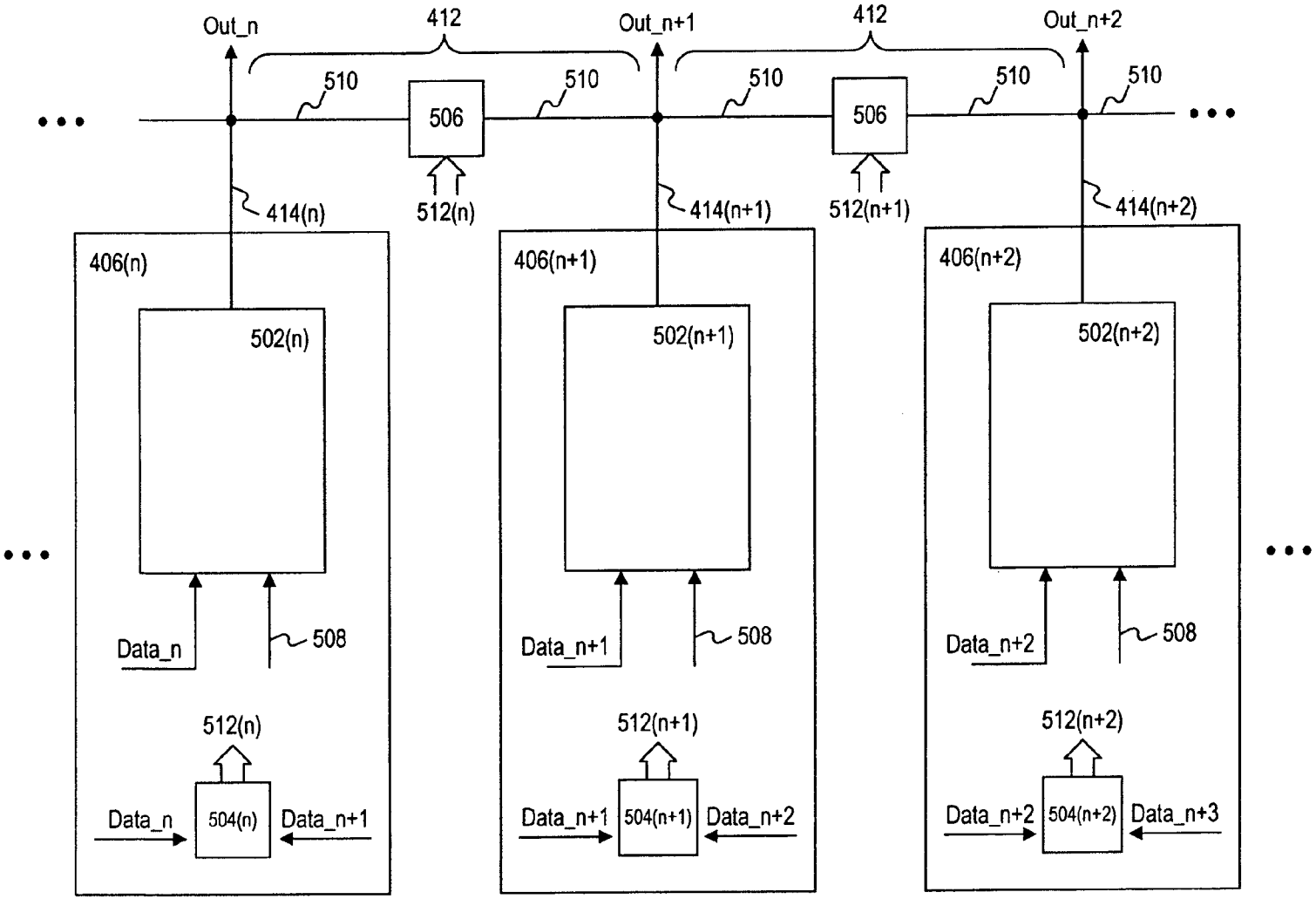
FIG. 5 is a block diagram representation of driver units shown in FIG. 3 consistent with the first exemplary embodiment.

FIG. 5 shows the configuration of driver units 406 in greater detail. A driver unit 406(*n*) represents the driver unit associated with the "nth" column line, where "n" is an arbitrary, non-negative integer. Similarly, a driver unit 406(*n*+1) is adjacent to driver units 406(*n*), and represents the driver unit associated with the "n+1" column. These designators, n, n+1, . . . are also used below to identify associated features. Furthermore, though not explicitly shown, since there are K columns, there are K driver units 406. Each driver unit 406 includes a column line driver circuit 502 and a data compare circuit 504. In addition, outputs of adjacent driver units 406 are coupled together via lines 412. Lines 412 include a switching component 506 coupled to outputs of adjacent driver units 406 via lines 510.

Column line driver circuit 502(*n*) of driver unit 406(*n*), for example, is coupled to matrix of pixel elements 310 via column line 414(*n*). Column line driver circuit 502(*n*) may be configured to receive any appropriate input signals. For example, driver circuit 502(*n*) receives an input signal 508 representing a set of reference gamma voltages and a display data signal Data_n corresponding to one or more of the display pixels in the column associated with driver unit 502(*n*). Similarly, column line driver circuits 502 in "other" driver units 406, such as 502(*n*+1) and 502(*n*+2), receive similar input signals. Each column line driver circuit 502 supplies driver signals to column line 414 to drive pixel elements 424 based on the received display data signal corresponding to the associated column line 414 and input signal 508. For example, column line driver circuit 502(*n*) receives display data signal Data_n and input signal 508, and supplies drive signal Out_n to column line 414(*n*).

A first exemplary data compare circuit 504 is coupled to switching component 506 via line 512. Persons of ordinary skill in the art will now appreciate that data compare circuit 504 may include any circuit capable of comparing two values and outputting a signal based on the comparison. Data compare circuit 504 may be configured to receive any appropriate signal known in the art. For instance, data compare circuit 504(*n*) receives display data signals Data_n and Data_n+1, associated with adjacent columns of pixel elements in matrix of display pixel elements 310. Data compare circuit 504 may also be configured to output any appropriate signal known in the art. For example, data compare circuit 504(*n*) supplies a control signal to switching component 506 via line 512(*n*). The control signal supplied from data compare circuit 504 controls switching component 506 so that adjacent column lines, such as 414(*n*) and 414(*n*+1), can be electrically coupled via lines 510 when the display data signals Data_n and Data_n+1 are the same.

The resistance of switching component 506 is chosen to be low enough to reduce the difference between outputs of adjacent driver units 406. Thus, electrically coupling adjacent column lines 414 is intended to make the outputs of adjacent driver units 406, i.e., their drive signals, the same or substantially the same when, for a row currently being driven, pixels in adjacent columns are to be driven according to display data signals having the same value. This, in turn, causes the outputs of associated pixel elements 424, which may be characterized as the display pixel brightness level, to be the same or substantially the same. As previously explained, visual perception is more sensitive to the effect of display pixel element brightness variations between adjacent pixel elements, than brightness variations between pixel elements that are not adjacent. Thus, because the outputs of adjacent pixel elements 424 are caused to be the same or substantially the same, the visual effects of non-uniformity of outputs from adjacent driver units 406 are reduced. Electrically coupling adjacent column lines 414 together to make the outputs of adjacent driver units 406 the same or substantially the same overcomes the prior art problems discussed above because this technique is independent of process technology, does not increase power consumption, and only requires a relatively small increase in circuit complexity, as compared to the prior art techniques.

Figure 6:
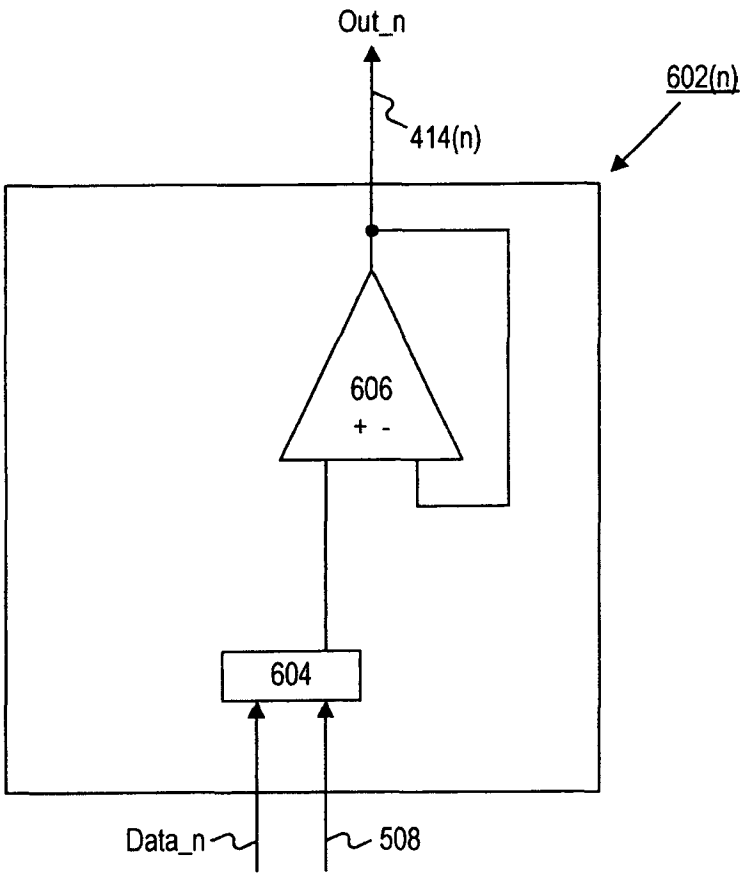
FIG. 6 is a block diagram of a first exemplary variation of a column line driver circuit shown in FIG. 5.

FIG. 6 shows a first exemplary variation of column line driver circuit 502 as a column line driver circuit 602(*n*). Column line driver circuit 602(*n*) may be representative of other or all column line driver circuits, e.g., 502(*n*+1), 502 (*n*+2). Column line driver circuit 602(*n*) includes an analog source buffer 606 and a decoder 604. Column line driver circuit 602(*n*) may also include an output control component (not shown) configured to control the output of column line driver circuit 602(*n*) based on an output control signal. An output of decoder 604 is coupled to an input of analog source buffer 606. Column line driver circuit 602(*n*) may be configured to receive any appropriate signals known in the art. In the present example, decoder 604 of column line driver circuit 602(*n*) receives signal 508 representing the set of reference gamma voltages and a display data signal Data_n corresponding to the display pixels in the column associated with column line driver circuit 602(*n*). Decoder 604 uses Data_n to decode or select the appropriate voltage from the set of reference gamma voltages 508. Decoder 604 also operates as a digital-to-analog converter and converts Data_n into a corresponding analog voltage display data signal. Decoder 604 supplies the analog voltage display data signal to analog source buffer 606.

Analog source buffer 606 is configured to receive the output of decoder 604 and output a drive signal corresponding to the received output of decoder 604, e.g., Out_n. Analog source buffer 606 buffers an analog voltage signal as the drive signal to drive pixel elements 424 in the associated column line 414. The drive signal may be any appropriate drive signal. For example, analog source buffer 606 according to the first exemplary variation of column line driver circuit 602(*n*) can be provided as an operational amplifier. The operational amplifier outputs buffered voltage drive signals, such as Out_n, to column line 414(*n*) corresponding to the output signal received from decoder 604.

Figure 7:
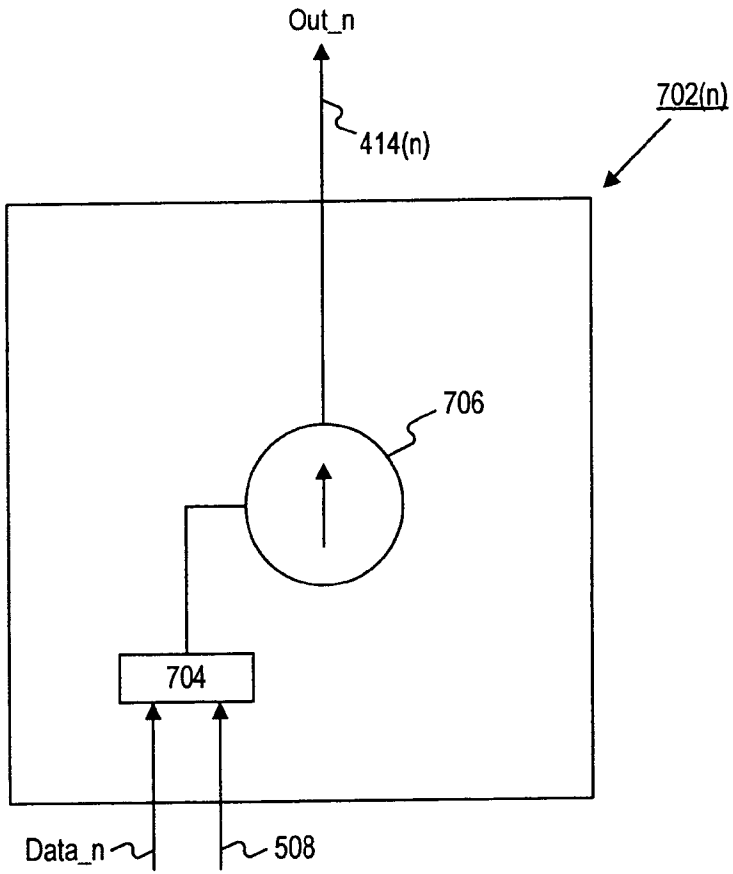
FIG. 7 is a block diagram of a second exemplary variation of the column line driver circuit shown in FIG. 5.

FIG. 7 shows a second exemplary variation of column line driver circuit 502 as a column line driver circuit 702(*n*) that operates in current-mode. Column line driver circuit 702(*n*) may be representative of other or all column line driver circuits, e.g., 502(*n*+1), 502(*n*+2). Column line driver circuit 702(*n*) includes a segment cell 706 and a decoder 704. Column line driver circuit 702(*n*) may also include an output control component (not shown) configured to control the output of column line driver circuit 702(*n*) based on an output control signal. An output of decoder 704 is coupled to an input of segment cell 706. Decoder 704 of column line driver circuit 702(*n*) may receive any appropriate signals known in the art. In the present example, decoder 704 receives signal 508 representing the set of reference segment currents and a display data signal, Data_n, corresponding to display pixel elements in column line 414(*n*) associated with column line driver circuit 702(*n*). Decoder 704 uses display data signal Data_n to decode or select the appropriate output current from the set of reference segment currents 508. Decoder 704 also operates as a digital-to-analog converter and converts Data_n into a corresponding current drive display data signal, and performs other appropriate data pre-conditioning such as pre-processing to account for gamma data and grey scale driving scheme. Decoder 704 supplies the current drive display data signal to segment cell 706.

Segment cell 706 is configured to receive the output of decoder 704 and output a drive signal corresponding to the received output, and thus serves as a segment driver. The drive signal may be any appropriate drive signal. For example, segment cell 706 can be provided as a constant current source, and thus outputs current driving signals, such as Out_n, to column line 414(*n*) corresponding to the output signal received from decoder 704.

Figure 8:
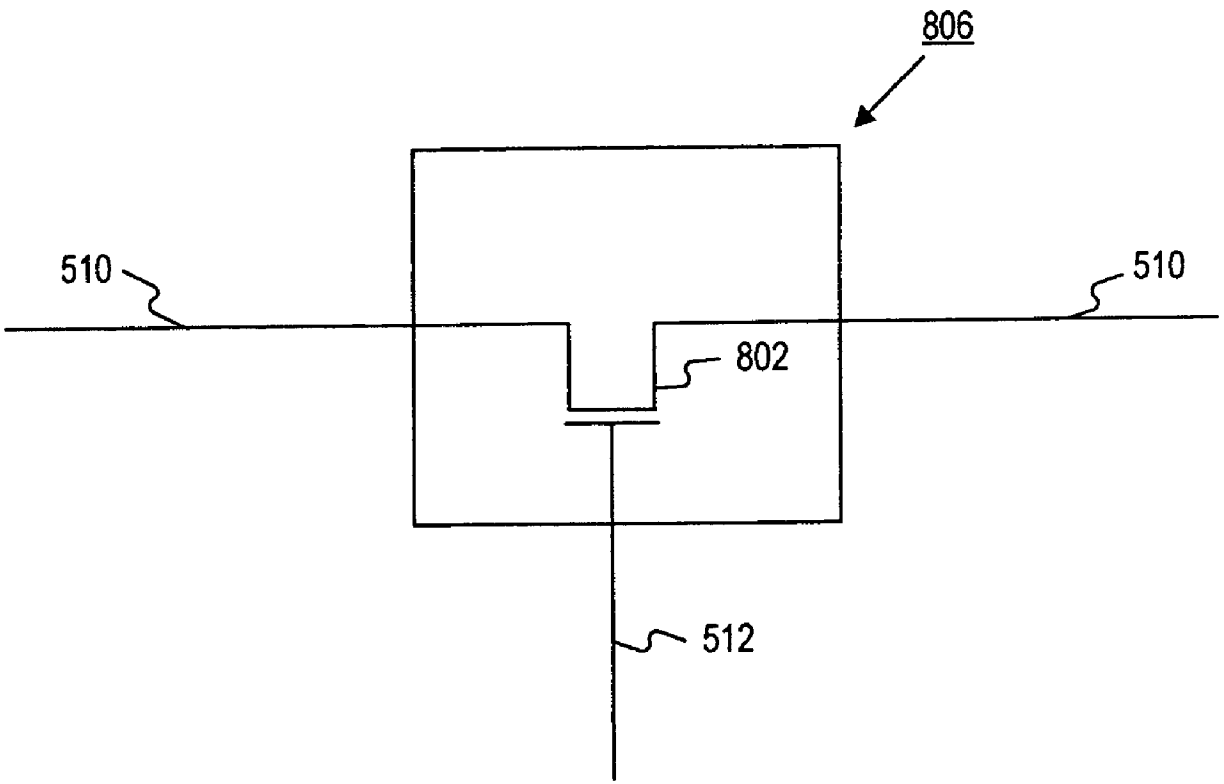
FIG. 8 is a block diagram of a first exemplary variation of a switching component shown in FIG. 5.

FIG. 8 shows a first exemplary variation of switching component 506 as a switching component 806. Switching component 806 is coupled to adjacent column lines 414 (not shown) via lines 510. Switching component 806 includes an electronic switching device 802, which is normally non-conductive. Electronic switching device 802 may be any appropriate switching device known in the art. In the example shown in FIG. 8, electronic switching device 802 is a MOSFET with its gate configured to receive signals from line 512 and its source and drain coupled to lines 510. Switching component 806 may receive any appropriate signals, for example, a control signal from data compare circuit 504 via line 512. The control signals from data compare circuit 504 may control switching component 806 to electrically couple adjacent column lines 414 via lines 510. For example, assuming switching electronic switching device 802 is the MOSFET configured as shown in FIG. 8, data compare circuit 504 sends a control signal to the gate of the MOSFET to turn the MOSFET "on" (conducting). When the MOSFET is turned on, it electrically couples adjacent column lines 414 associated with switching component 806.

Figure 9:
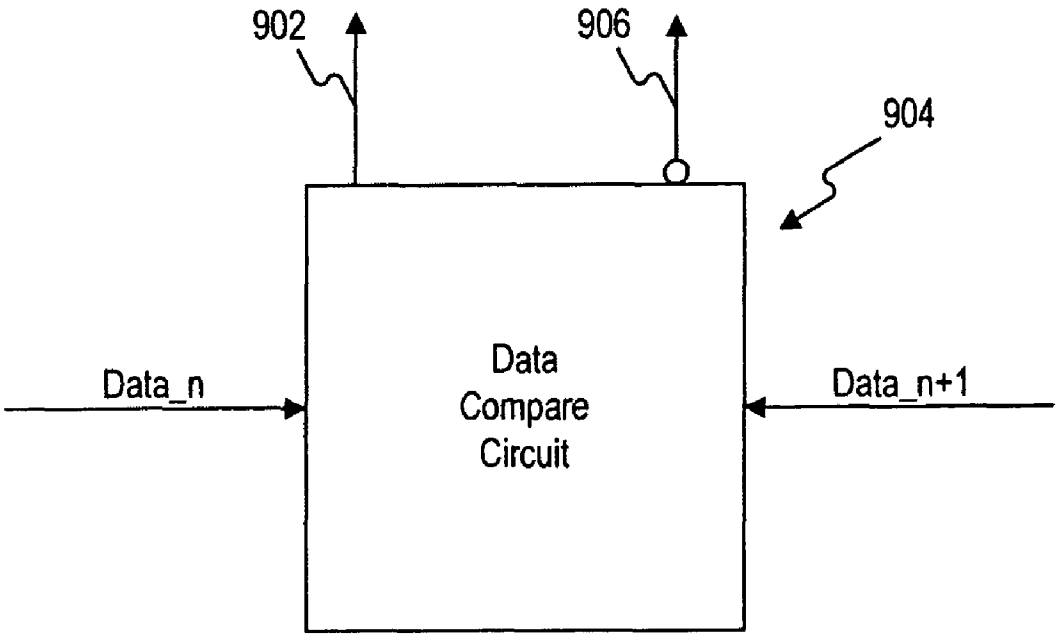
FIG. 9 is a block diagram representation of an exemplary variation of the data compare circuit shown in FIG. 5.

FIG. 9 shows a second exemplary variation of data compare circuit 504 as a data compare circuit 904. Persons of ordinary skill in the art will now appreciate that data compare circuit 904 may include any circuit capable of comparing two data values and outputting an output signal based on the comparison. Data compare circuit 904 may be configured to receive any appropriate signal, for example, data signals corresponding to pixel elements 424 associated with adjacent column lines 414. FIG. 9 shows data compare circuit 904 receiving display data signals Data_n and Data_n+1, and outputting control signals 902 and 906. Data compare circuit 904 may, however, output any appropriate signal or signals. Control signals 902 and 906 are provided to control switching component 506, and are complementary signals, i.e., with opposite polarities.

Figure 10:
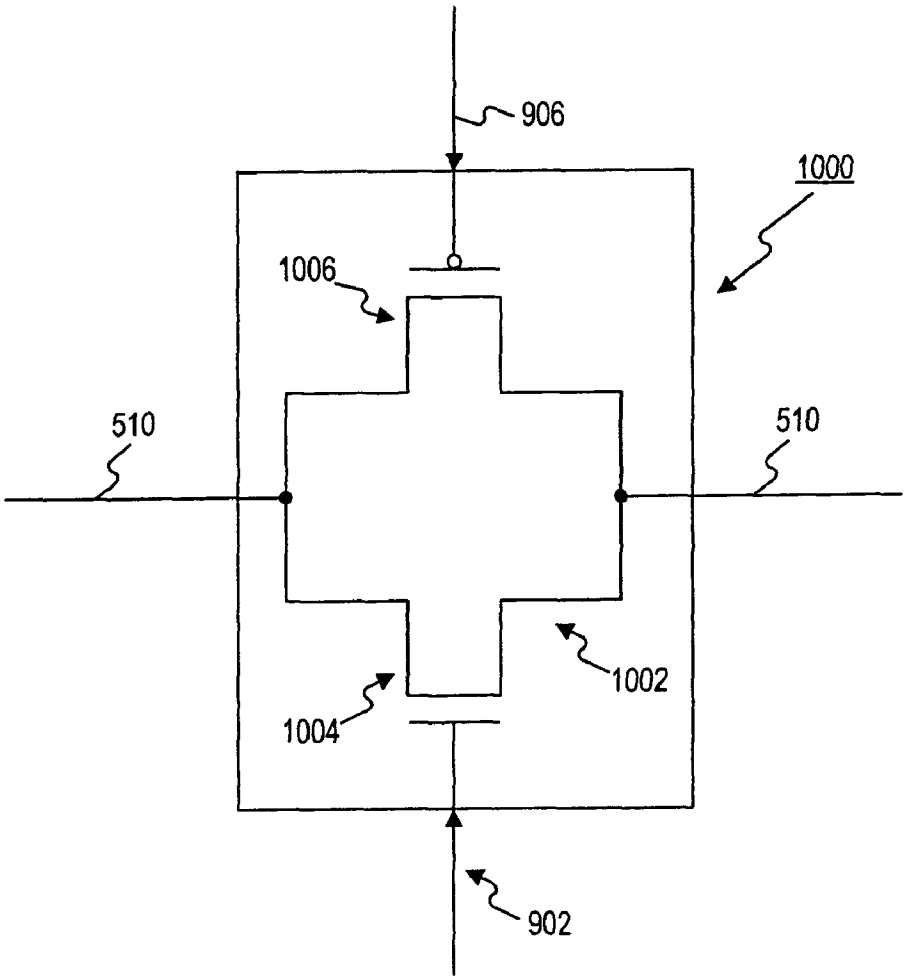
FIG. 10 is a block diagram of a second exemplary variation of the switching component shown in FIG. 5.

FIG. 10 shows a second exemplary variation of switching component 506 as a switching component 1000. Switching component 1000 is coupled to adjacent column lines 414 via lines 510. Switching component 1000 includes an electronic switching device 1002, which is normally non-conductive. Electronic switching device 1002 may be any appropriate switching device known in the art. In the example shown in FIG. 10, electronic switching device 1002 includes two complementary MOSFETs provided as an n-MOSFET 1004 and a p-MOSFET 1006 coupled in parallel. Switching device 1002 may receive any appropriate signals, such as complementary control signals 902 and 906, from the second exemplary data compare circuit 904 shown in FIG. 9, applied to n-MOSFET 1004 and p-MOSFET 1006, respectively. Complementary control signals 902 and 906 from data compare circuit 904 control switching component 1002 to selectively electrically couple adjacent column lines 414 via lines 510.

Figure 11:
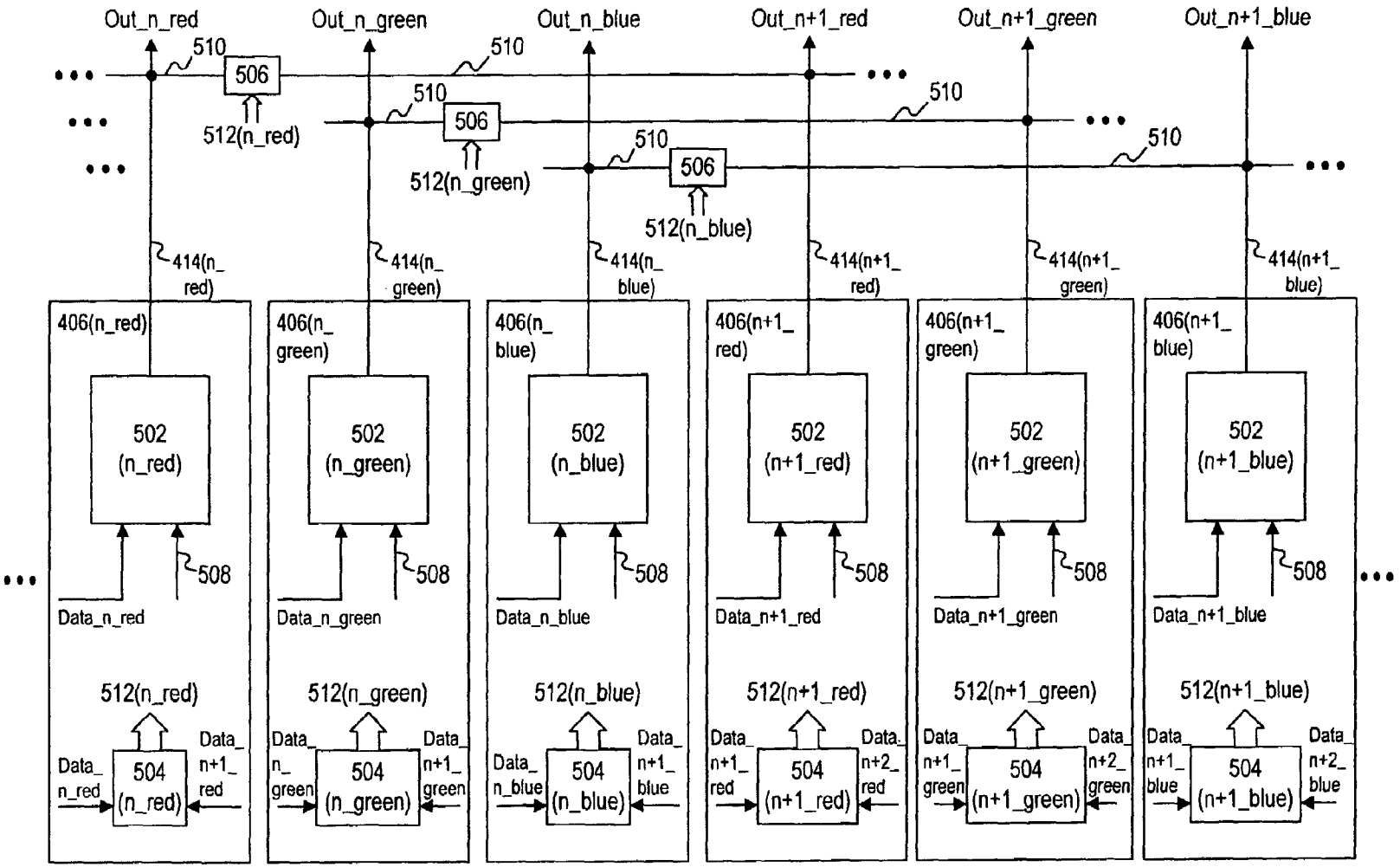
FIG. 11 is a block diagram representation of the driver units shown in FIG. 4 consistent with a second exemplary embodiment.

FIG. 11 shows an exemplary configuration of driver units 406 according to a second exemplary embodiment. In FIG. 11, driver units 406 according to the second exemplary embodiment drive color display pixel elements 424 based on received color display data signals, such as Data_n_red, Data_n_green, and Data_n_blue. Color display pixel elements 424 for each available row and column combination may be represented in groups of three pixels, where the pixels in each group represent the primary colors red, green, and blue. Pixels in the group are controlled to output any appropriate color, based on a combination of the primary colors represented by the pixels in the group. Furthermore, the color display data signal may represent the primary colors, red, green, and blue.

Driver units 406 according to the second exemplary embodiment are configured to operate in the same manner as driver units 406 of the first exemplary embodiment, shown in FIG. 5. In the second exemplary embodiment, however, adjacent column lines 414 are defined as adjacent columns associated with the same primary color, while the column lines 414 are not necessarily physically adjacent to each other. For example, FIG. 11 shows driver unit 406(*n*_red) and driver unit 406(*n*+1_red) coupled via switching component 506. Thus, according to the second exemplary embodiment, column lines 414 associated with these driver units 406 are considered adjacent. Similar to the first exemplary embodiment, when data compare circuit 504(*n*_red) determines that display data signals Data_n_red and Data_n+1_red are the same, data compare circuit 504(*n*_red) controls switching component 506, via line 512(*n*_red), to electrically couple the column lines 414 associated with the outputs of adjacent "red" driver units 406(red), Out_n_red and Out_n+1_red. Components associated with green and blue pixels elements operate substantially the same as do the components described above for the red pixel elements.

In summary, selectively electrically coupling adjacent column lines 414 is intended to make the outputs of adjacent driver units 406 the same or substantially the same when display data signals supplied to the associated driver units 406 are the same. This, in turn, makes the outputs of associated pixel elements 424, which may be characterized as the display pixel brightness level, the same or substantially the same. This technique overcomes the prior art problems associated with driver unit output non-uniformity because it is independent of process technology, does not increase power consumption, and only requires a relatively small increase in circuit complexity, as compared to the prior art techniques.

In the preceding specification, the invention has been described with reference to specific exemplary embodiments thereof. It will, however, be evident that various modifications and changes may be made thereunto without departing from the broader spirit and scope of the invention as set forth in the claims that follow. The specification and drawings are accordingly to be regarded in an illustrative rather than restrictive sense.

What is claimed is:

1. A driver circuit for providing driving signals to drive a plurality of display pixel elements arranged in a plurality of rows and columns in a display system, the rows and columns of display pixel elements being coupled to associated ones of the row and column lines, respectively, the driver circuit comprising:

a plurality of driver units coupled to associated ones of the plurality of column lines, each of the driver units being configured to receive display data signals for the associated column line and an adjacent one of the column lines, and to provide a drive signal on a driver unit output to the display pixel elements coupled to the associated column line; and a plurality of switching components respectively coupled between the outputs of ones of the driver units coupled to adjacent ones of the plurality of column lines, and configured to electrically couple the adjacent outputs in response to a control signal from an associated one of the driver units when the display data signals for the adjacent column lines are the same;

wherein each of the plurality of driver units includes:

a column line driver circuit configured to supply the drive signal corresponding to the display data signals to the associated column line for the associated pixel elements coupled thereto; and a data compare circuit configured to receive the display data signals for the associated column line and the adjacent one of the column lines, and to provide a signal to a one of the switching components coupled between the outputs of the associated driver unit and a one of the driver units associated with the adjacent column line to electrically couple the adjacent outputs.

2. The driving circuit according to claim 1, wherein each of the switching components further comprises:

at least one switch responsive to the control signal.

3. The driving circuit according to claim 1, wherein the control signal comprises a pair of complementary signals, and each of the switching components further comprising:

complementary switches responsive to the pair of complementary signals.

4. The driving circuit according to claim 1, wherein each of the driver units is a voltage driver.

5. The component according to claim 4, wherein each of the voltage drivers comprises:

a decoder to decode a received one of the display data signals and to provide an analog display data signal; and an analog source buffer coupled to receive the analog display data signal and provide the drive signal.

6. The component according to claim 1, wherein each of the driver units is a current driver.

7. The component according to claim 6, wherein each of the current drivers comprises:

a decoder to decode a received one of the display data signals and to provide a current drive display data signal; and a segment cell coupled to receive the current drive display data signal and provide the drive current.

8. A method for controlling driving signals from a driver circuit to drive a plurality of display pixel elements arranged in a plurality of rows and columns in a display system, the rows and columns of display pixel elements being coupled to associated row and column lines, respectively, the method comprising:

receiving display data signals for associated column lines;

providing drive signals to display pixel elements in associated column lines; and coupling together adjacent column lines when the display data signals associated with the adjacent columns lines are the same, to make the drive signals provided to the adjacent column lines the same;

wherein the coupling comprises:

comparing the received display data signals associated with the adjacent column lines to determine whether the display data signals associated with the adjacent column lines are the same; and selectively controlling a switching component to couple together the adjacent column lines based on the result of the comparison.

9. The method according to claim 8, wherein the provided drive signals correspond to the associated display data signal.

10. A display system, comprising:

a plurality of display pixel elements arranged in a plurality of rows and columns;

a plurality of row and column lines, where the rows and columns of display pixel elements are coupled to associated ones of the row and column lines, respectively;

a controller; and a driver circuit including a gate driver, a column shift register, a plurality of driver units coupled to the column shift register and having outputs respectively coupled to associated ones of the plurality of column lines, and a plurality of switching components respectively coupled between the outputs of ones of the driver units coupled to adjacent ones of the plurality of column lines, wherein each of the driver units is configured receive display data signals for the associated column line and an adjacent one of the column lines, and to provide the drive signal on the driver unit output to the display pixel elements coupled to the column line associated with the driver unit; and the plurality of switching components configured to electrically couple the driver unit outputs coupled to the adjacent column lines in response to a control signal from an associated one of the driver units when the display data signals for the adjacent column lines are the same.

11. The display system according to claim 10, wherein each of the switching components further comprises:

at least one switch responsive to the control signal.

12. The display system according to claim 10, wherein the control signal comprises a pair of complementary signals, each of the switching components further comprising:

complementary switches responsive to the pair of complementary signals.

13. The display system according to claim 10, wherein each of the driver units is a voltage driver.

14. The display system according to claim 13, wherein each of the voltage drivers comprises:

a decoder to decode a received one of the display data signals and to provide an analog display data signal; and an analog source buffer coupled to receive the analog display data signal and provide the drive signal.

15. The display system according to claim 10, wherein each of the driver units is a current driver.

16. The display system according to claim 15, wherein each of the current drivers comprises:

a decoder to decode a received one of the display data signals and to provide a current drive display data signal; and a segment cell coupled to receive the current drive display data signal and provide the drive current.

* * * * *